US006191746B1

(12) United States Patent
Nagy

(10) Patent No.: US 6,191,746 B1
(45) Date of Patent: Feb. 20, 2001

(54) FM DIVERSITY FEED SYSTEM FOR THE SOLAR-RAY ANTENNA

(75) Inventor: Louis Leonard Nagy, Warren, MI (US)

(73) Assignees: General Motors Corporation, Detroit; Delphi Technologies Inc., Troy, both of MI (US)

( * ) Notice: Under 35 U.S.C. 154(b), the term of this patent shall be extended for 0 days.

(21) Appl. No.: 09/354,753

(22) Filed: Jul. 29, 1999

(51) Int. Cl.[7] ..... H01Q 1/32
(52) U.S. Cl. ..... 343/713; 343/711
(58) Field of Search ..... 343/713, 711, 343/718, 712; H01Q 1/32

(56) References Cited

U.S. PATENT DOCUMENTS 5,528,314 6/1996 Nagy et al. ..... 348/713
5,739,794 4/1998 Nagy et al. ..... 343/713

FOREIGN PATENT DOCUMENTS

06338715 * 6/1994 (JP) .

* cited by examiner

*Primary Examiner*—Hoanganh Le
*Assistant Examiner*—Ephrem Alemu
(74) *Attorney, Agent, or Firm*—George A. Grove

(57) ABSTRACT

An FM diversity feed for a solar-ray antenna system formed in the windshield of a vehicle. The FM diversity feed includes a conductive patch formed on an inside surface of an inner glass layer of the windshield at one of the lower corners of the windshield. The diversity feed is capacitively coupled to an impedance matching element of the solar-ray antenna formed between an outer glass layer and the inner glass layer of the windshield.

20 Claims, 2 Drawing Sheets

FM DIVERSITY FEED SYSTEM FOR THE SOLAR-RAY ANTENNA

TECHNICAL FIELD

This invention relates generally to a vehicle antenna and, more particularly, to a solar-ray vehicle antenna provided in the windshield of a vehicle for AM/FM radio reception that includes a second antenna feed for providing FM diversity.

BACKGROUND OF THE INVENTION

Most modern vehicles include a vehicle radio that requires an antenna system to receive amplitude modulation (AM) and frequency modulation (FM) broadcasts from various radio stations. Present-day vehicle antenna systems may include a mast antenna that extends from a vehicle fender, vehicle roof, or some applicable location on the vehicle. Although mast antennas provide acceptable AM and FM reception, it has been recognized by vehicle manufacturers that the performance of a mast antenna cannot be significantly increased, and therefore, improvements obtained in other areas of in-vehicle entertainment systems will not include reception capabilities of the mast antenna. Consequently, vehicle manufacturers have sought other types of antenna designs to keep pace with consumer demands for increased vehicle stereo and radio capabilities.

Improvements in vehicle antenna systems have included the development of backlite antenna systems, where antenna elements are formed on a rear window of the vehicle in various designs. Backlite antenna systems have provided a number of other advantages over mast antenna systems, including no wind noise, reduced drag on the vehicle, elimination of corrosion of the antenna, no performance change with time, limited risk of vandalism, and reduced cost and installation.

A new concept for antenna systems has been invented to provide an antenna between the inner and outer laminated glass sheets of a vehicle windshield. U.S. Pat. No. 5,528,314, entitled "Transparent Vehicle Window Antenna" issued Jun. 18, 1996, and U.S. Pat. No. 5,739,794 entitled "Vehicle Window Antenna With Parasitic Slot Transmission Line," issued Apr. 14, 1998, disclose "Solar-Ray" antennas of this type.

FIG. 1 is a diagrammatic view of a Solar-Ray vehicle antenna 10 of the type disclosed in these patents laminated in a windshield 12 of a vehicle 16. FIG. 2 is a diagrammatic view of the windshield and solar-ray antenna 10 removed from the vehicle 16. The windshield 12 is mounted within an opening of a vehicle body 14 that is made of an electrically conductive metal, such as steel or aluminum, by known window mounting techniques. The windshield 12 includes a horizontal dark tinted region 18 formed along a top border of the windshield 12 that reduces glare for the vehicle operator. The translucent nature of the tinted region 18 can be used to reduce the visibility of the antenna 10.

The antenna 10 is provided in the windshield 12 as a conductive film applied to the inner surface of an outer glass of the windshield 12 to be contained between outer and inner glass layers of the windshield 12. The film of the antenna 10 is essentially transparent to visible light, highly reflective of infrared radiation, electrically conducting, and preferably has a sheet resistance of 3 ohms per square or less. An example of a suitable film material is described in U.S. Pat. No. 4,898,789 to Finlay, issued Feb. 6, 1990. The film described herein can include a first anti-reflective metal oxide layer, such as oxide of zinc and tin, an infrared reflection metal layer, such as silver, a primer layer containing titanium, a second metal oxide layer, a second infrared reflective metal layer, such as silver, another primer layer, a third anti-reflective metal oxide layer, and an exterior protective layer of titanium metal or titanium oxide.

The antenna 10 includes two basic elements—a horizontally elongated tuning element 20 substantially parallel to and spaced from a top edge 22 of the window 12, and an impedance matching element 24. The tuning element 20 is essentially rectangular, although its horizontal edges may follow the curvature of the window edge 22 and its corners may be rounded for a more pleasing appearance. The tuning element 20 has an effective horizontal length of an odd integer multiple of one-quarter of the wavelength to which it is tuned, and thus exhibits a zero reactive impedance at the tuned wavelength. Different tuning element configurations can be provided in different designs. In one embodiment, the tuning element 20 is tuned to a wavelength in the center of the FM frequency band (88 MHz–108 MHz), such as three meters, and thus has an effective horizontal length of about 0.75 meters. The physical length of the element 20 at resonance is actually somewhat shorter than one-quarter of the center frequency of the FM band to provide coupling to the vehicle body 14. The length by which the element 20 is shorter will vary with the specific vehicle application. In one particular vehicle, the tuning element 20 has been found to work well with a horizontal length of 60 cm and a vertical width of 50 mm. The element 20 is ideally spaced below the window edge 22 by a distance which provides maximum FM gain. However, this distance may be compromised to gain other advantages for a particular vehicle design. The antenna 10 provides AM reception through capacitive coupling with the vehicle body 14.

The impedance element 24 includes a main body portion 28 which covers substantially all or most of the windshield 10 below the tinted region 18 to provide FM impedance matching. In the '794 patent, the impedance element can be a ribbon in various configurations to form a parasitic slot transmission line for FM impedance matching purposes. The main portion 28 has a peripheral edge 32 with a horizontal upper portion 34 spaced at least 25 mm below the lower edge of the element 20, so as to minimize transmission coupling effects therebetween. The upper portion 34 is connected to the element 20 by a narrow vertical portion 36 to provide an electrical current flow. The upper portion 34 of the peripheral edge 32 is preferably within the tinted region 18 of the windshield 12 along its entire length from one side to the other side of the windshield 12, so that the tinted region 18 overlaps the main portion 28 of the element 24. The remaining portion of the peripheral edge 32 is spaced a certain distance from the edge of the vehicle body 14 so as to provide, in combination therewith, a planar slot transmission line that is parasitically coupled to the element 20. In one embodiment, the distance between the edge of the vehicle body 14 and the main portion 28 is preferably within the 10–25 mm range. The length of the slot is substantially an integer multiple of one-half of the wavelength to which the tuning element 20 is tuned, so that each end of the slot transmission line, at the junctions of the upper portion 34 and the remaining portion of the peripheral edge 32, appears as an electrical open circuit.

The impedance element 24 is used to adjust the real component of the antenna's impedance to match the characteristic impedance, typically 125 ohms, of the coaxial cable used to feed the antenna 10. This is accomplished by the predetermined width between the remaining portion of the peripheral edge 32 and the adjacent portion of the edge of the window 12. For appearance purposes, and to maximize the infrared reflecting efficiency of the windshield 12, an opaque painted band 40 may be provided around the sides and bottom of the windshield 12 to substantially or completely cover the area outward from the remainder portion of the peripheral edge 32 to the outer edge of the windshield 12. This band can be broken into dots of decreasing size toward the inner boundary for a fade-out effect, as known in the industry. If such a band is provided in combination with the tinted region, substantially the entire viewing area of the windshield 10 can be uniformly provided with the infrared reflecting film of the antenna 10.

The impedance element 24 also provides an added benefit at AM wavelengths. At these longer wavelengths, the antenna 10 is not a resonant antenna, but is substantially a capacitive antenna. The large area of the element 24 provides a substantial boost in gain for the antenna 10, as compared with similar planar and other antennas in the prior art. In fact, the boost in AM gain is so great that some of it can be sacrificed, if desired, in fine tuning the antenna performance for further improvements in FM gain, directional response, or other characteristics while still yielding good AM performance.

In order to connect the antenna 10 to a radio or other communications system, a connection arrangement is necessary for an external coaxial cable. In this embodiment, the antenna 10 is extended into a narrow strip 38 (about 25 mm wide), upward from the center of the element 20, and almost to the upper edge of the windshield 12. An inner conductor 42 of a coaxial cable 44 is electrically connected to the narrow strip 38 to feed the tuning element 20. In one embodiment, the inner conductor 42 is electrically connected to a patch 46 formed on an inside surface of the inner layer of the windshield 12. An outer conductor 48 of the coaxial cable 44 is connected to the vehicle body 14 at a convenient point close to where the inner conductor 42 is coupled to the feed point. Any suitable feed connection can be provided between the tuning element 20 and the center conductor 48 of the coaxial cable 44 within the skilled of the art.

Vehicle antenna reception and performance can be increased by providing compensation or correction for broadcast reception when the primary feed system provided by the narrow strip 38 is positioned at a null location, and the antenna 10 is prevented from receiving suitable signal strength. For example, buildings, mountains, etc., may cause reception problems when the vehicle is positioned at a certain location. The reflection of the FM signals from the various bodies in the reception area causes the signals to interact with each other creating null locations from destructive interference. This type of antenna null is caused by the spatial location of the feed system. Other types of nulls are caused by signal configuration as a result of signal pattern and polarization.

To address this problem, it would be desirable to increase antenna performance by providing feed diversity for the nulls caused by signal interference. This feed diversity should include space diversity, pattern diversity and polarization diversity. It is known to provide multiple vehicle antennas on the vehicle with the idea that if one of the antennas is positioned at a signal null location, the other antenna may be in a location to receive suitable signal strength. The vehicle antenna orientation relative to the signal determines how well the reception is achieved relative to signal strength. However, providing multiple antennas positioned at different locations of the vehicle significantly increases the cost of the vehicle antenna system.

What is needed is an FM diversity feed in combination with a primary antenna feed for a single vehicle antenna that meets desirable antenna cost and complexity. It is therefore an object of the present invention to provide such a secondary antenna system.

SUMMARY OF THE INVENTION

In accordance with the teachings of the present invention, a second FM diversity feed is provided in combination with an existing AM/FM antenna system, such as the known solar-ray antenna system. The second or FM diversity feed for the solar-ray antenna system can be located at one of the lower corners of the vehicle windshield. This location minimizes the coupling between the two feeds, provides an antenna impedance of approximately 50 ohms, and provides a distance separation between the two feeds of at least one-quarter wavelength at the center of the FM frequency band. In one embodiment, the FM diversity feed is a conductive patch formed on the inside surface of the vehicle windshield, so that it overlaps the conductive film of the solar-ray antenna element and is capacitively coupled to the conductive film through the window. Additional objects, advantages and features of the present invention will become apparent from the following description and appended claims taken in conjunction with the accompanying drawings.

DESCRIPTION OF THE PREFERRED EMBODIMENT

Figure 1:
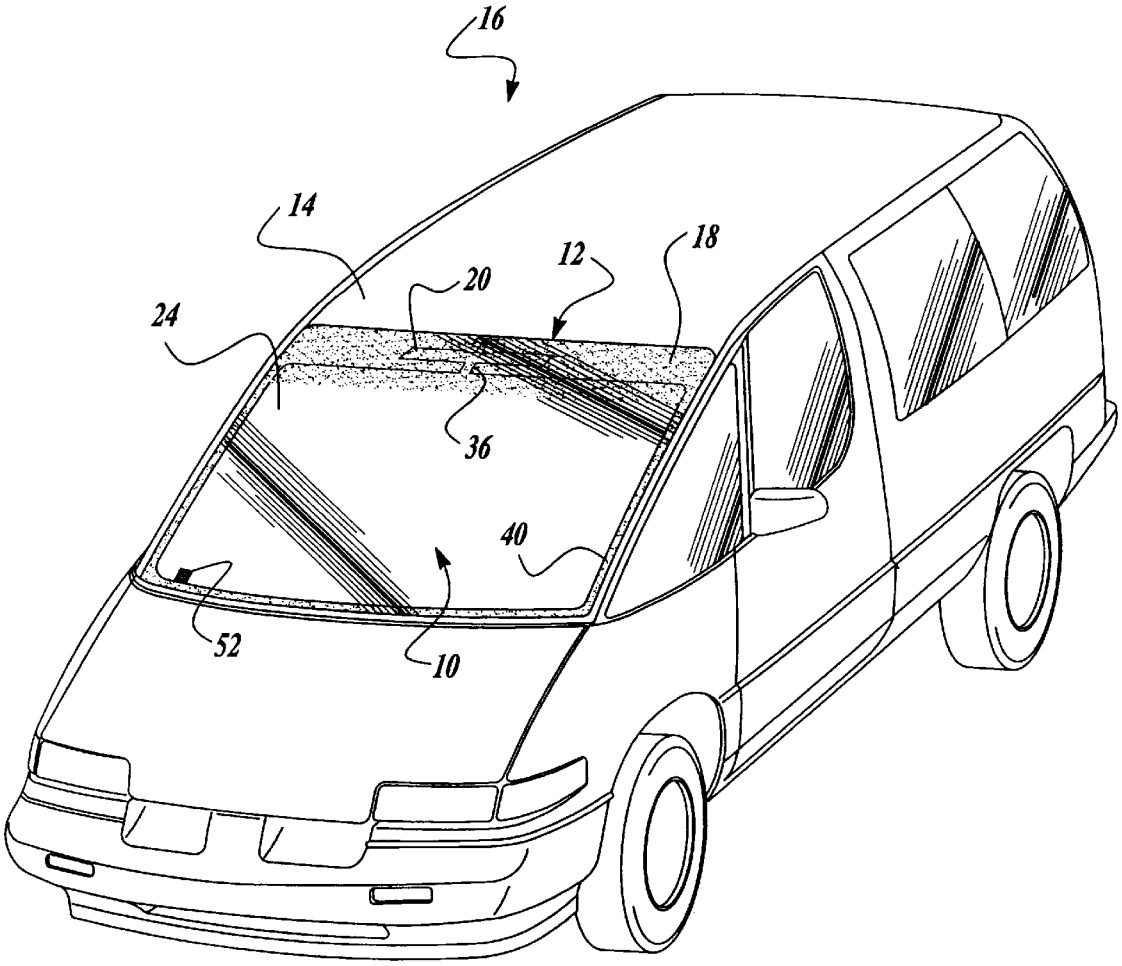
FIG. 1 is a perspective view of a solar-ray antenna in a vehicle windshield within a vehicle including an FM diversity feed according to the invention.
Figure 2:
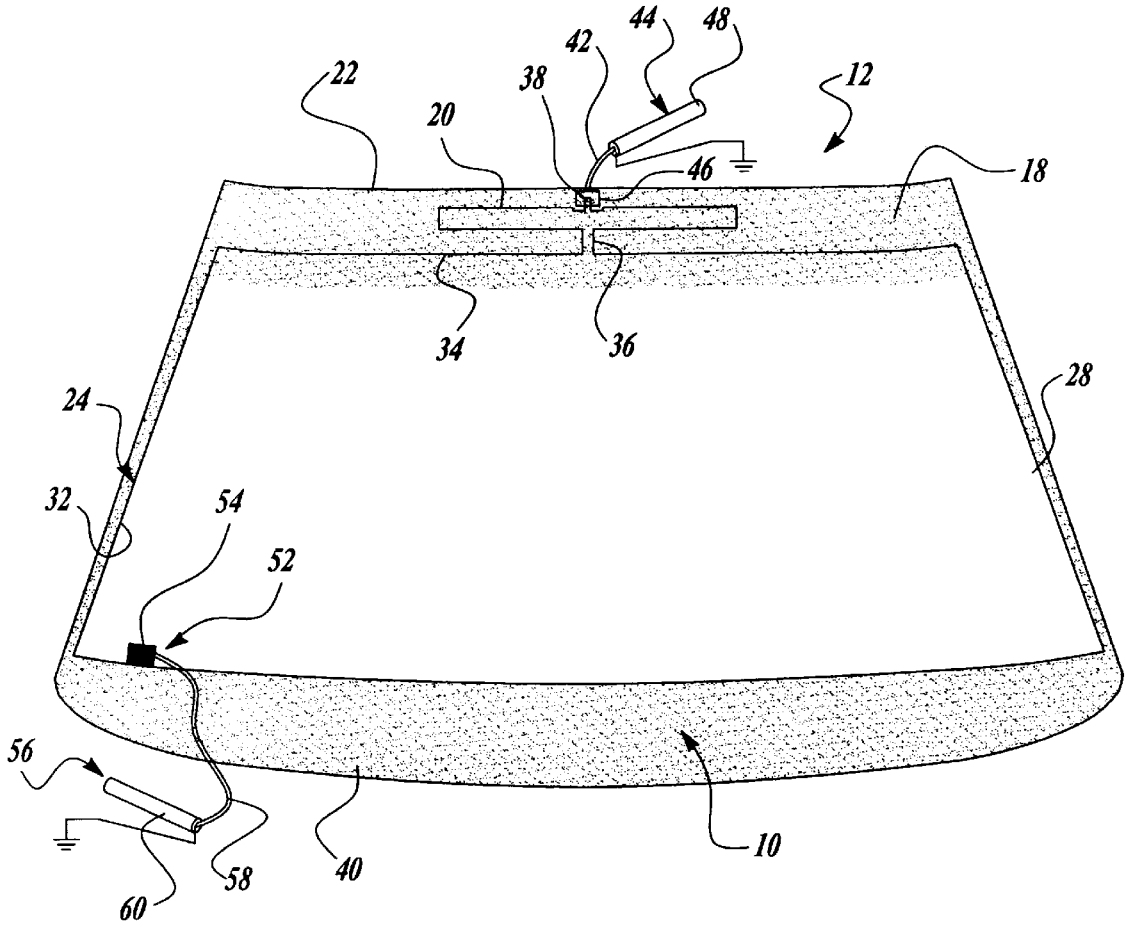
FIG. 2 is a diagrammatic view of the windshield antenna shown in FIG. 1 removed from the vehicle, and including the FM diversity feed according to the invention.

The following discussion of the preferred embodiments directed to an FM diversity feed for a vehicle antenna is merely exemplary in nature and is in no way intended to limit the invention or its applications or uses. Particularly, the FM diversity feed will be discussed in connection with a solar-ray antenna in a vehicle windshield. However, the combination of the FM diversity feed and the primary FM feed is applicable to other vehicle antenna systems, for example, a vehicle backlite antenna.

The antenna 10 includes an FM diversity feed 52 provided in the windshield 12 for FM diversity reception. The FM diversity feed 52 includes a conductive patch 54 deposited on the inside surface of the inner layer of the windshield 12. In one embodiment, the patch 54 is a 2"×2" piece of material to provide suitable FM reception. The feed 52 can make direct electrical contact with the impedance element 24 in one embodiment. However, because the impedance element 24 is between the two layers of glass of the windshield 12, and the feed 52 is formed on an inside surface of the inner layer of the windshield 12, it is more cost effective to provide a capacitive coupling between the patch 54 and the element 24. Therefore, the feed 52 is positioned on the inside surface of the inside layer of the windshield 12 so that it overlaps the element 24. In those designs where the impedance element 24 is a conductive ribbon formed around the perimeter of the windshield 12 to form the parasitic slot transmission line, the feed 52 would still be capacitively coupled to the ribbon.

In one embodiment, the feed 52 is positioned at a lower corner of the windshield 12 so that it is distant from the primary feed of the cable 44 electrically connected to the strip 38. The particular location was selected to minimize the coupling between the two feed systems, provide an antenna impedance of approximately 50 ohms, and create a distance separation between the two feeds of at least a one-quarter wavelength of the center frequency of the FM band. Additionally, by positioning the diversity feed 52 remote from the primary feed in a vertical direction, the diversity feed 52 is better able to provide all of space diversity, pattern diversity and polarization diversity requirements.

As discussed above, the FM diversity feed 52 is connected to the matching slot transmission line section of the solar-ray antenna 10 provided by the impedance element 24. When the diversity feed 52 is being used for FM reception, the parasitic impedance element 24 then becomes the tuning element for FM reception. A coaxial cable 56 including an inner conductor 58 connected to the patch 54 and an outer conductor 60 connected to the vehicle ground is provided to connect the feed 52 to the diversity circuit. A minimum length of the coaxial cable 56 is necessary for impedance matching purposes. The coaxial cable 56 and the cable 44 would be connected to a suitable antenna switching system (not shown) that is operated by a logic function that determines when the primary feed is not receiving significant signal strength to switch the antenna feed over to the diversity feed 52.

In an embodiment for a more practical and less costly manufacturing situation, the patch 54 is positioned on the inner surface of the glass layer so that it overlaps the impedance element 24, but at a location to the left or right of the tuning element 20 adjacent the window edge in an upper corner of the windshield 12. This reduces the cost of forming the patch 54 on the windshield 12.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An antenna system for a vehicle, said vehicle having a conductive vehicle body that acts as an electrical ground, said antenna system including an electrically conducting structure formed on a vehicle window, said system comprising:

an antenna tuning element;

an impedance matching element electrically connected to the tuning element, said impedance matching element providing impedance matching relative to the vehicle body;

a first FM antenna feed electrically coupled to the tuning element, said first antenna feed including a first coaxial cable having an inner conductor electrically coupled to the tuning element and an outer conductor electrically coupled to the vehicle body; and a second FM antenna feed electrically coupled to the impedance matching element, said second antenna feed including a second coaxial cable having an inner conductor electrically coupled to the impedance matching element and an outer conductor electrically coupled to the vehicle body.

2. The antenna system according to claim 1 wherein the second feed includes a conductive patch formed on a surface of the window.

3. The antenna system according to claim 2 wherein the conductive patch is a square patch formed on the inside surface of the window.

4. The antenna system according to claim 3 wherein the conductive patch is positioned at a lower corner of the window and is about 2"×2" square.

5. The antenna system according to claim 3 wherein the second antenna feed provides impedance matching of approximately 50 ohms.

6. The antenna system according to claim 1 wherein the antenna tuning element and the impedance matching element are formed on the window between a first glass layer and a second glass layer of the window.

7. The antenna system according to claim 6 wherein the second feed is capacitively coupled to the impedance element through one of the glass layers of the window.

8. The antenna system according to claim 1 wherein the second feed is positioned on the window vertically separated from the first feed relative to the travelling direction of the vehicle.

9. The antenna system according to claim 1 wherein the window includes an upper dark tinted region, said tuning element being disposed within the tinted region.

10. The antenna system according to claim 1 wherein the antenna tuning element and the impedance matching element are part of a solar-ray antenna system.

11. A solar-ray antenna system for a vehicle positioned on a windshield of the vehicle, said vehicle having a conductive vehicle body that acts as an electrical ground, said windshield including an outer glass layer and an inner glass layer, said system comprising:

an elongated antenna tuning element disposed between the outer and inner glass layers at an upper portion of the windshield;

an impedance matching element disposed between the outer and inner glass layers at a bottom portion of the windshield and being electrically connected to the elongated tuning element by a first narrowed conductive portion, said impedance matching element providing impedance matching relative to the vehicle body;

a first antenna feed electrically coupled to the tuning element through a second narrowed conductive portion on an opposite side of the tuning element from the first narrowed conductive portion, said first antenna feed including a first coaxial cable having an inner conductor electrically coupled to the tuning element and an outer conductor electrically coupled to the vehicle body; and a second FM antenna feed electrically coupled to the impedance matching element at a location in a parasitic slot transmission line defined between the impedance matching element and the conductive body of the vehicle, said second antenna feed including a second coaxial cable having an inner conductor electrically coupled to the impedance matching element and an outer conductor electrically coupled to the vehicle body.

12. The antenna system according to claim 11 wherein the second feed includes a conductive patch formed on an inside surface of the inside layer of the windshield.

13. The antenna system according to claim 12 wherein the conductive patch is a square patch having a dimension of 2"×2".

14. The antenna system according to claim 12 wherein the conductive patch overlaps the impedance element and is capacitively coupled through the inner glass layer thereto.

15. The antenna system according to claim 11 wherein the impedance matching element is a conductive ribbon formed around a portion of the perimeter of the windshield.

16. The antenna system according to claim 11 wherein the second antenna feed is positioned in a corner of the impedance element longitudinally disposed from the tuning element.

17. The antenna system according to claim 11 wherein the impedance matching element is a conductive film that covers most of the area of the windshield.

18. A method of feeding a vehicle antenna system positioned on a vehicle window, said vehicle having a conductive vehicle body that acts as an electrical ground, said method comprising the steps of:

providing an antenna tuning element in the vehicle window;

providing an impedance matching element in the window and electrically connected to the tuning element, said impedance matching element providing impedance matching relative to the conductive body;

feeding the antenna from a first feed location electrically coupled to the tuning element, said first antenna feed including a first coaxial cable having an inner conductor electrically coupled to the tuning element and an outer conductor electrically coupled to the vehicle body; and feeding the antenna from a second feed location electrically coupled to the impedance matching element, said second antenna feed including a second coaxial cable having an inner conductor electrically coupled to the impedance matching element and an outer conductor electrically coupled to the vehicle body.

19. The method according to claim 18 wherein the steps of feeding the antenna include capacitively coupling the first feed to the tuning element and the second feed to the impedance matching element.

20. The method according to claim 18 wherein the steps of providing a tuning element and an impedance matching element include providing a solar-ray antenna.

* * * * *